US007798873B1

(12) United States Patent
Dai et al.

(10) Patent No.: US 7,798,873 B1
(45) Date of Patent: Sep. 21, 2010

(54) DESIGN OF A FLUSH INLET AS INTEGRATED WITH A SHIP HULL FOR WATERJET PROPULSION

(75) Inventors: Charles M. Dai, Potomac, MD (US); Carol L. Tseng, Potomac, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 350 days.

(21) Appl. No.: 11/169,262

(22) Filed: Jun. 22, 2005

(51) Int. Cl.
*B63H 11/103* (2006.01)

(52) U.S. Cl. ..... 440/47; 440/38

(58) Field of Classification Search ..... 440/47, 440/38

See application file for complete search history.

(56) References Cited

U.S. PATENT DOCUMENTS

| | | | | |
|---|---|---|---|---|
| 3,464,357 | A * | 9/1969 | Martin et al. | 415/193 |
| 3,531,214 | A * | 9/1970 | Abramson | 415/68 |
| 3,942,463 | A | 3/1976 | Johnson, Jr. et al. | |
| 4,531,920 | A | 7/1985 | Stricker | |
| 5,415,122 | A | 5/1995 | Shen | |
| 5,439,402 | A | 8/1995 | Dai et al. | |
| 5,445,105 | A | 8/1995 | Chen et al. | |
| 5,456,200 | A | 10/1995 | Shen | |
| 5,476,401 | A | 12/1995 | Peterson et al. | |
| 5,591,057 | A | 1/1997 | Dai et al. | |
| 5,632,658 | A | 5/1997 | Chen et al. | |
| 5,694,535 | A | 12/1997 | Broekhuijsen | |
| 6,171,159 | B1 | 1/2001 | Shen et al. | |
| 6,629,866 | B2 | 10/2003 | Burg | |
| 2002/0052156 | A1 | 5/2002 | Burg | |
| 2002/0127925 | A1 | 9/2002 | Burg | |
| 2003/0154897 | A1 | 8/2003 | Burg | |
| 2003/2228214 | | 12/2003 | McBride | |

OTHER PUBLICATIONS

Analytical Methods, Inc. (AMI; Computational Fluid Dynamics Software and Consulting Services) website, home web page (1 page) printed out on Mar. 13, 2006 at http://www.am-inc.com/.

(Continued)

*Primary Examiner*—Edwin Swinehart
(74) *Attorney, Agent, or Firm*—Howard Kaiser

(57) ABSTRACT

The present invention's methodology for designing a fluid propulsion intake configuration of a marine vessel considers the integral geometry of the inlet together with a portion of the hull, with respect to which the inlet's entrance opening is flush. The inventive methodology typically includes definition of an inlet reference line (an "axial" description, straight and/or curved, of the inlet), cross-planes (each of which perpendicularly intersects the inlet reference line), a footprint (a planar outline of the inlet's entrance opening), an inlet shaping line (a projection of the footprint onto the hull portion), inlet flow lines (angularly spaced about the circumference of the inlet shaping line, each connecting the cross-planes), two fairing reference curves (one at the inlet's entrance opening and the other on the hull portion, thereby demarcating a fairing therebetween that is consistent with the inlet flow lines), and a lip nose (at the inlet's entrance opening).

5 Claims, 10 Drawing Sheets

OTHER PUBLICATIONS

Analytical Methods, Inc. (AMI; Computational Fluid Dynamics Software and Consulting Services) website, "Software" web page (2 pages) printed out on Mar. 13, 2006 at http://www.am-inc.com/software.shtml.

Analytical Methods, Inc. (AMI; Computational Fluid Dynamics Software and Consulting Services) website, "VSAERO" web page (2 pages) printed out on Mar. 13, 2006 at http://www.am-inc.com/VSAERO.

B. Maskew, Analytical Methods, Inc. (AMI), "Program VSAERO: A Computer Program for Calculating the Non-Linear Aerodynamic Characteristics of Arbitrary Configurations, User's Manual," NASA-CR-166476, Prepared for NASA Ames Research Center under Contract No. NAS2-8788 (date for general release Dec. 1984), 177 pages.

Engineering Research Center Computational Simulation and Design Center (ERC SimCenter) of the College of Engineering of Mississippi State University, home web page (2 pages) printed out on Mar. 13, 2006 at http://www.simcenter.msstate.edu/.

Engineering Research Center Computational Simulation and Design Center (ERC SimCenter) of the College of Engineering of Mississippi State University, "Gallery" web page (3 pages) printed out on Mar. 13, 2006 at http://www.simcenter.msstate.edu/simcenter/gallery.

Eric L. Blades, David L. Marcum, Brent Mitchell, "Simulation of Spinning Missile Flow Fields Using $U^2$NCLE," $20^{th}$ AIAA Applied Aerodynamics Conference, St. Louis, Missouri, Jun. 24-26, 2002, AIAA-2002-2797, 11 pages.

"Go With the Flow: Analytical Methods—VAERO, Spinoff 2000, p. 72," NASA Ames Technology website, printed out on Feb. 11, 2005 at http://www.amestechnology.org/ames/success-story-text.asp?NAME=flow.html.

*The Quarterly Digest of CDI Marine Systems Development Division* (SDD) (Formerly Band, Lavis & Associates), 900 Ritchie Highway, Severna Park, Maryland, 21146, 6 pages (pp. 1-6), vol. 27, face-dated Jun. 2004; see, esp., John Purnell, "Design of Inlets for Marine Waterjet Propulsion," pp. 2-5.

* cited by examiner

Perspective View of Inlet 20 on a Body of Revolution 220

DESIGN OF A FLUSH INLET AS INTEGRATED WITH A SHIP HULL FOR WATERJET PROPULSION

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to waterjet propulsion of a marine vessel, more particularly to methodologies for designing, in furtherance of waterjet propulsion of a marine vessel, a configuration including a flush inlet and a portion of a marine hull.

The design of a flush inlet for a ship with jet propulsion has traditionally been approached in an ad hoc fashion, lacking analytical procedures that relate geometric parameters to the design predictions. In particular, these conventional methodologies fail to take into consideration the influence of the ship hull on the flush inlet performance and vice versa.

The inlet performance is critical to the success of a waterjet propulsion system. There are major effects associated with inlet-hull interactions. First, the inlet, in conjunction with the hull, constitutes an important hydrodynamic interaction problem that can greatly affect the drag characteristics of the ship. The drag can either be reduced or augmented relative to the hull without inlet. The inlet flow can also affect the trim of the ship and subsequently the drag. The location of the inlet on the ship hull is an important consideration for the drag problem.

The inlet also changes the hull flow characteristics in the vicinity of the inlet. The flow inside the inlet can be subject to adverse pressure gradient, and flow separation can be prominent if no systematic method is available to relate flow characteristics to geometric parameters. The stagnation flow near the lip region of the inlet is critical for good cavitation performance.

In addition, the inlet geometry has a significant effect on pump performance. The proper shaping of the inlet is important to have minimum dynamic head losses in the flow passage, due both to turning and to frictional losses at the wall. The flow in front of the pump face needs to be as uniform as possible to minimize unsteady flow behavior of the pump. The interactions between the inlet and hull must be favorable to propulsion without inducing flow separation and/or cavitation.

The following United States patent documents, hereby incorporated herein by reference, are of interest as pertaining to waterjet propulsion of marine vessels: McBride, "Mixed Flow Pump," U.S. Patent Application Publication No. US 2003/02228214 A1 published 11 Dec. 2003; Burg, "Marine Vehicle Propulsion System," U.S. Pat. No. 6,629,866 B2 issued 7 Oct. 2003; Burg, "Waterjet Propulsor for Air Lubricated Ships," U.S. Patent Application Publication No. US 2003/0154897 A1 published 21 Aug. 2003; Burg, "Augmented Waterjet Propulsor," U.S. Patent Application Publication No. US 2002/0127925 A1 published 12 Sep. 2002; Burg, "Marine Vehicle Propulsion System," U.S. Patent Application Publication No. US 2002/0052156 A1 published 2 May 2002; Shen et al., "Steering and Backing Systems for Waterjet Craft with Underwater Discharge," U.S. Pat. No. 6,171,159 B1 issued 9 Jan. 2001; Chen et al., "Tractor Podded Propulsor for Surface Ships," U.S. Pat. No. 5,632,658 issued 27 May 1997; Dai et al., "Hull Supported Steering and Reversing Gear for Large Waterjets," U.S. Pat. No. 5,591,057 issued 7 Jan. 1997; Peterson et al., "Compact Water Jet Propulsion System for a Marine Vehicle," U.S. Pat. No. 5,476,401 issued 9 Dec. 1995; Chen et al., "Torque Balanced Postswirl Propulsor Unit and Method for Eliminating Torque on a Submerged Body," U.S. Pat. No. 5,445,105 issued 29 Aug. 1995; Stricker, "Transverse Waterjet Propulsion with Auxiliary Inlets and Impellers," U.S. Pat. No. 4,531,920 issued 30 Jul. 1985; Johnson, Jr. et al., "Movable Ramp Inlet for Water Jet Propelled Ships," U.S. Pat. No. 3,942,463 issued 9 Mar. 1976.

SUMMARY OF THE INVENTION

In view of the foregoing, it is an object of the present invention to provide a method for designing, in integrative fashion, a combination associated with waterjet propulsion of a marine vessel, said combination including a flush inlet and a marine hull or portion thereof.

It is a further object of the present invention to provide such a method that promotes the powering efficiency of a waterjet propelled marine vessel.

The present invention represents a synergistic methodology for integratively designing a flush inlet together with a vehicular hull. The present invention is usually practiced in association with a marine hull, such as a hull in the nature of a monohull (e.g., for a surface ship) or a hull in the nature of a body of revolution (e.g., for a submersible). Inventive practice is possible with respect to vehicular hulls of diverse shapes and dimensions. Typical inventive practice serves to further the efficiency of the powering performance of a jet-propelled ship. The inventive methodology takes into account the effects of the ship hull in the design of a flush inlet for waterjet propulsion.

Featured by the present invention is a geometric specification scheme that allows systematic variations in geometric parameters to affect design performances, e.g., powering and cavitation. The inventive design methodology enables design optimization for an inlet-hull configuration. The typical inventive design procedure uses a systematic characterization of inlet geometry. The present invention's analytically defined parametric inlet design process can be synergistically applied with respect to any given hull configuration. Inlet shaping can be of any geometric form that the inventive designer-practitioner specifies, depending upon the hull flow condition.

According to typical inventive embodiments, an analytically defined lip geometric specification is inventively provided that can be modified according to the stagnation streamline information during the design iteration process. The present invention gives an explicit characterization of lip geometry that can provide good design practices for pressure recovery and good cavitation performance. Geometric parameters are inventively provided that can be varied to reduce dynamic head losses and minimize the flow non-uniformity in front of the pump face. The present invention also facilitates rapid integration of inlet-plus-hull as one integrated hydrodynamic component.

The inventive methodology is typically practiced for designing the geometry of vehicular structure relating to fluid intake for fluid propulsion. In most applications, the present invention pertains to a waterjet-propelled marine vessel that includes a flush water inlet. A typical inventive method comprises: (a) defining a global configuration including a fluid inlet and a hull portion; (b) defining a surface of the fluid inlet; (c) defining a fairing between the hull portion and the fluid inlet at the fluid entrance end; and, (d) defining a lip nose. The fluid inlet has a fluid entrance end and a fluid exit end. The fluid inlet is integrated flush with the hull portion at the fluid entrance end. The defining of a global configuration includes defining an inlet reference line and defining at least three cross-planes. Each cross-plane intersects the inlet reference line and is normal to the inlet reference line. A first cross-plane is located at the fluid entrance end. A second cross-plane is located at the fluid exit end. The inlet reference line extends between the centroid of the first cross plane and the centroid of the second cross-plane. The inlet reference line intersects the centroid of each cross-plane other than the first cross-plane and the second cross-plane. The defining of a surface includes defining a footprint, defining an inlet shaping line, and defining at least three inlet flow lines. The footprint represents a closed planar outline of the fluid inlet at the fluid entrance end of the fluid inlet. The inlet shaping line represents a projection of the footprint onto the hull portion. Each inlet flow line connects the cross-planes. The inlet flow lines are spaced at different angular positions around the circumference of the inlet shaping line. The defining of the inlet flow lines includes using, with respect to each inlet flow line, a fifth-order Bezier cross-link curve to connect the cross-planes at the corresponding angular position. The defining of a fairing includes defining two closed fairing reference curves. A first closed fairing reference curve is on the fluid inlet at the fluid entrance end and along the inlet flow lines. A second closed fairing reference curve is on the hull portion. The fairing extends between the two closed fairing reference curves. The footprint includes a lip section and a ramp section. The lip section is on the leading edge side of the footprint relative to the hull. The ramp section is on the trailing edge side of the footprint relative to the hull. The defining of a lip nose includes defining a nose reference line for the footprint, defining a lip outline projection, defining an elliptical nose, and blending the elliptical nose into the hull portion and a lip nose cutting plane. The lip outline projection represents a projection of the lip section onto the lip-cutting plane. The elliptical nose is characterized by a partial elliptical shape; the partial elliptical shape is blended into the lip outline projection, and the major elliptical axis (of the partial elliptical shape) coincides with the nose reference line. Some inventive embodiments include the additional step of actually making (e.g., constructing or fabricating) the vehicular structure so as to include the fluid inlet (which can include the lip nose), the hull portion, and the fairing.

The present invention is unique in that it allows for an integrated design of a flush inlet for marine jet propulsion on any given hull configuration. The geometric provisions and specifications presented hereinbelow by way of example are instructive as to the present invention's physically based, parametric, geometric modeling method for flush inlet design. The present invention's inlet design methodology, as typically embodied, is useful as a kind of modeling tool. When used in conjunction with any validated physics-based simulation tool (e.g., Reynolds Averaged Navier Stokes Solvers, or "RANS"), the present invention's inlet design methodology affords a robust, physics-based inlet design capability, and yields better inlet designs than do the conventional, ad hoc inlet design methodologies.

The present invention has several novel features, including global definition of the flush inlet configuration, an inlet surface generation scheme, a projection scheme, a fairing scheme, and a lip nose definition. According to the present invention's global definition of the flush inlet configuration, an arbitrary inlet reference line (an "axis" that generally describes the inlet) is defined, and a stacking scheme is devised that involves definitions of cross planes along and normal to the inlet reference line. The present invention's scheme for generating an inlet surface (including an inside surface) involves generation of inlet flow lines around the circumference of the inlet shaping line. The present invention's projection scheme projects the inlet footprint on a planar surface onto the hull surface in a controlled manner by using either uniform or non-uniform projection methods. The present invention's fairing scheme blends the inlet flow lines with the hull lines along specified directions. The present invention's lip nose definition provides analytical nose geometric definition.

One of the present joint inventors, Charles M. Dai, is also a joint inventor in a related invention entitled "Design of an Integrated Inlet Duct for Efficient Fluid Transmission," Charles M. Dai et al. U.S. Pat. No. 5,439,402 issued 8 Aug. 1995, incorporated herein by reference.

Other objects, advantages and features of this invention will become apparent from the following detailed description of the invention when considered in conjunction with the accompanying drawings.

BRIEF DESCRIPTION OF THE DRAWINGS

The present invention will now be described, by way of example, with reference to the accompanying drawings, wherein.

DETAILED DESCRIPTION OF THE INVENTION

Figure 1:
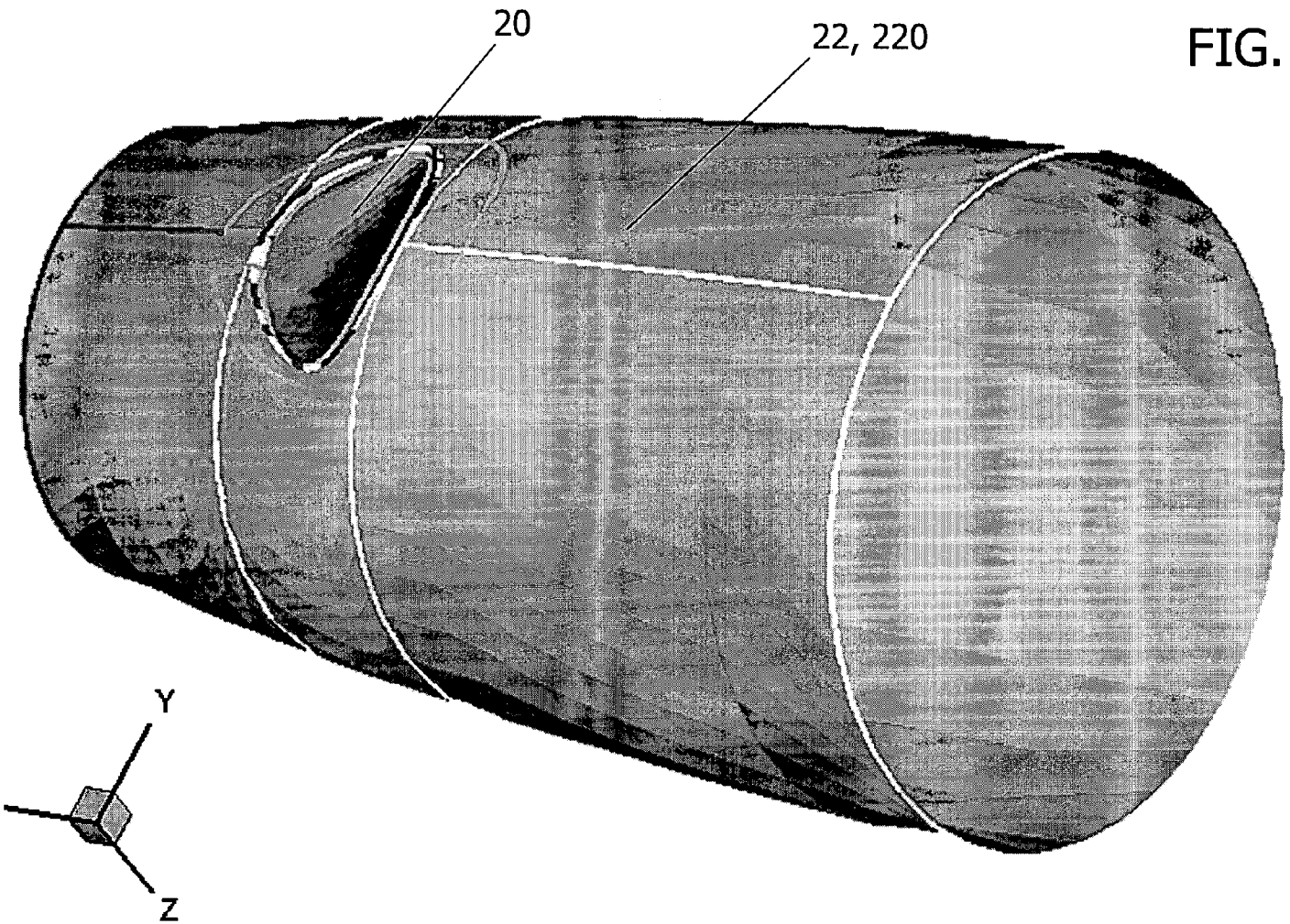
FIG. 1 is a perspective view of a typical integrated flush inlet plus hull configuration in accordance with the present invention.
Figure 2:
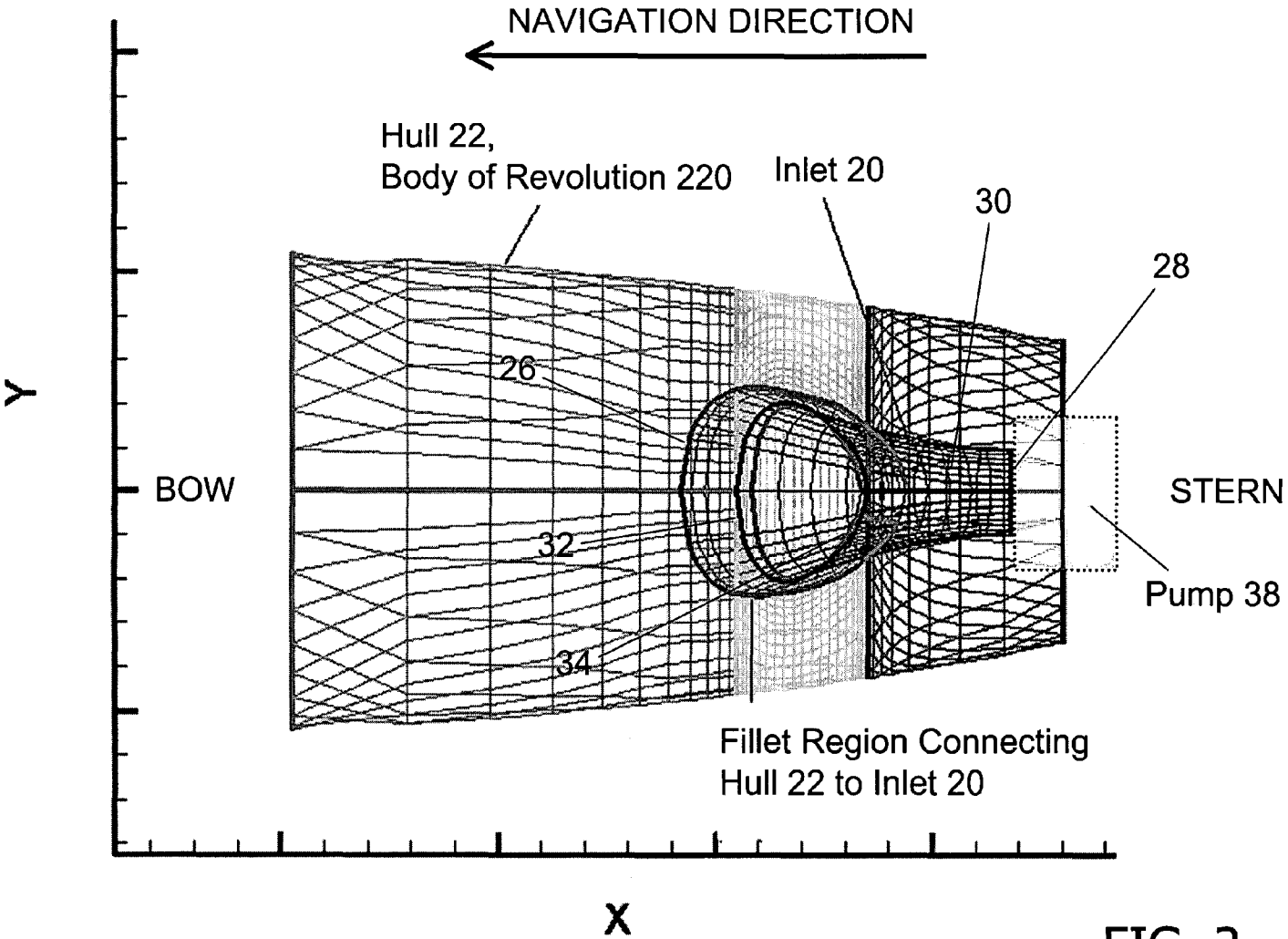
FIG. 2 is a plan view, from beneath the hull, of the inventive integrated inlet-hull configuration shown in FIG. 1.

Reference is now made to FIG. 1 and FIG. 2, which depict a typical integrated inlet-hull design in accordance with the present invention. FIG. 1 and FIG. 2 illustrate a flush inlet 20 in combination with a centralized portion of a marine hull 22. According to typical inventive embodiments, flush inlet 20 is located on, or in the vicinity of, the bottom of the hull 22. As shown by way of example in FIG. 1 and FIG. 2, marine hull 22 is for a submersible vehicle and is thus conceived to represent a body of revolution 220. Flush inlet 20 includes an inlet (fluid entrance) opening 26, an outlet (fluid exit) opening 28, and a flow passage 30. In the vicinity of the fore and aft areas, respectively, of fluid entrance opening 26 are the ramp face region 32 and the lip region 34.

Fluid entrance opening 26 is "flush" (generally even) with hull bottom 24. Fluid exit opening 28 is connected to the casing of a pump 38, represented diagrammatically in FIG. 2. As shown in FIG. 2, the bow and stern of marine hull 22, not shown, are conceived to be at the lefthand and righthand sides, respectively, and marine hull 22 is moving from right to left. During navigation by marine hull 22 of a body of water, water is constantly taken into flush inlet 20 (at inlet opening 26) and conducted by flush inlet 20 to pump 38, which pressurizes the water so as to facilitate waterjet propulsion of hull 22.

The present invention as typically embodied provides a geometric method for designing (e.g., modeling) a flush inlet 20 integrated with a hull 22 for marine applications. The inventive design method typically requires the following specifications: (i) the location, relative to hull 22, of the reference line (reference "axis") a of flush inlet 20; (ii) the inclination angle and geometric definition of the inlet reference line a; (ii) the shape of hull 22; (iv) the planar outline of the flush inlet 20 shape and its projection; (v) the area scheduling in the flow passage 30 of flush inlet 20; (vi) fairing control by angular and axial bias; (vii) the fairing of flush inlet 20 with hull 22 at the ramp face 32 of flush inlet 20; (viii) the lip 34 geometry specifications and fairing to hull 22.

Figure 3:
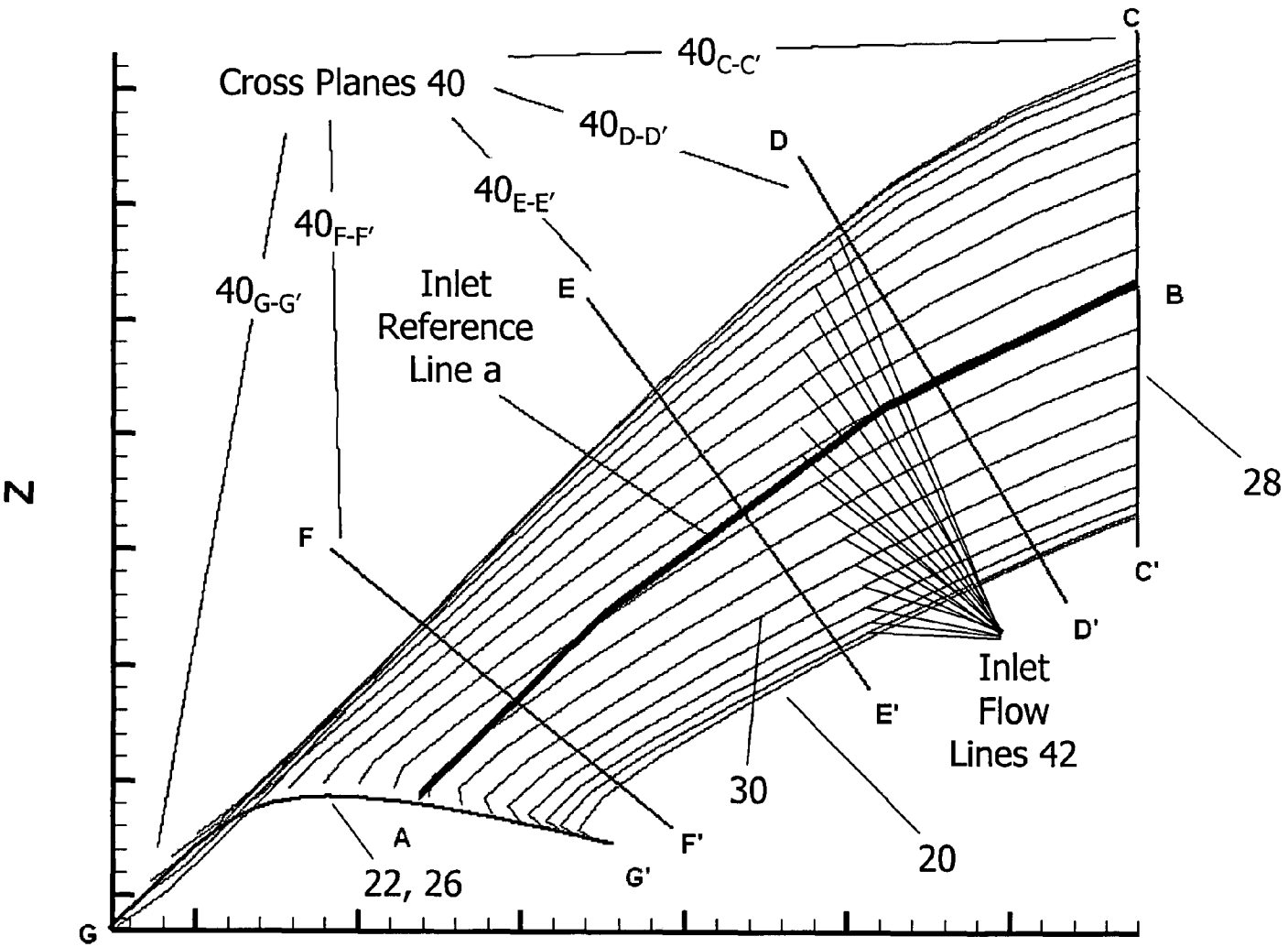
FIG. 3 is an elevation view of the inventive flush inlet shown in FIG. 1, illustrating the definitions of the inlet reference line and the cross planes.

With reference to FIG. 3, the flush inlet 20 geometry can be characterized by defining, for flush inlet 20, an inlet reference line (IRL) a. Inlet reference line a represents an axial or axis-like line of reference for flush inlet 20. Inlet reference line a can be a straight (linear) line, or a curved line, or a curvilinear line (having at least one straight portion and at least one curved portion). An inlet reference line a can be curved in two-dimensional plane or in three-dimensional space. More generally, the word "line" is used herein in the geometrically nonrestrictive sense of allowing for the possibility of a line of any shape (e.g., straight, curved or some combination thereof) and direction. As shown in FIG. 3, a side view of a typical inventive flush inlet 20, inlet reference line a is geometrical curved line "A-B." Inlet reference line a terminates at a point "B" that is next to pump 38, and originates at a point "A" that is approximately even or coplanar with the surface of hull bottom 24.

Selection of the origin of the inlet reference line a is important, as it has a major impact on the interaction between flush inlet 20 and hull 22. As shown in FIG. 3, inlet reference line a is inclined to hull 22. Reference line a must be defined by a geometric curve that originates at the hull bottom 24 surface (e.g., at a point "A" as shown in FIG. 3), and that terminates at a location (e.g., at a point "B" as shown in FIG. 3) where the flush inlet 20 will be connected to the pump 38 casing.

Figure 7:
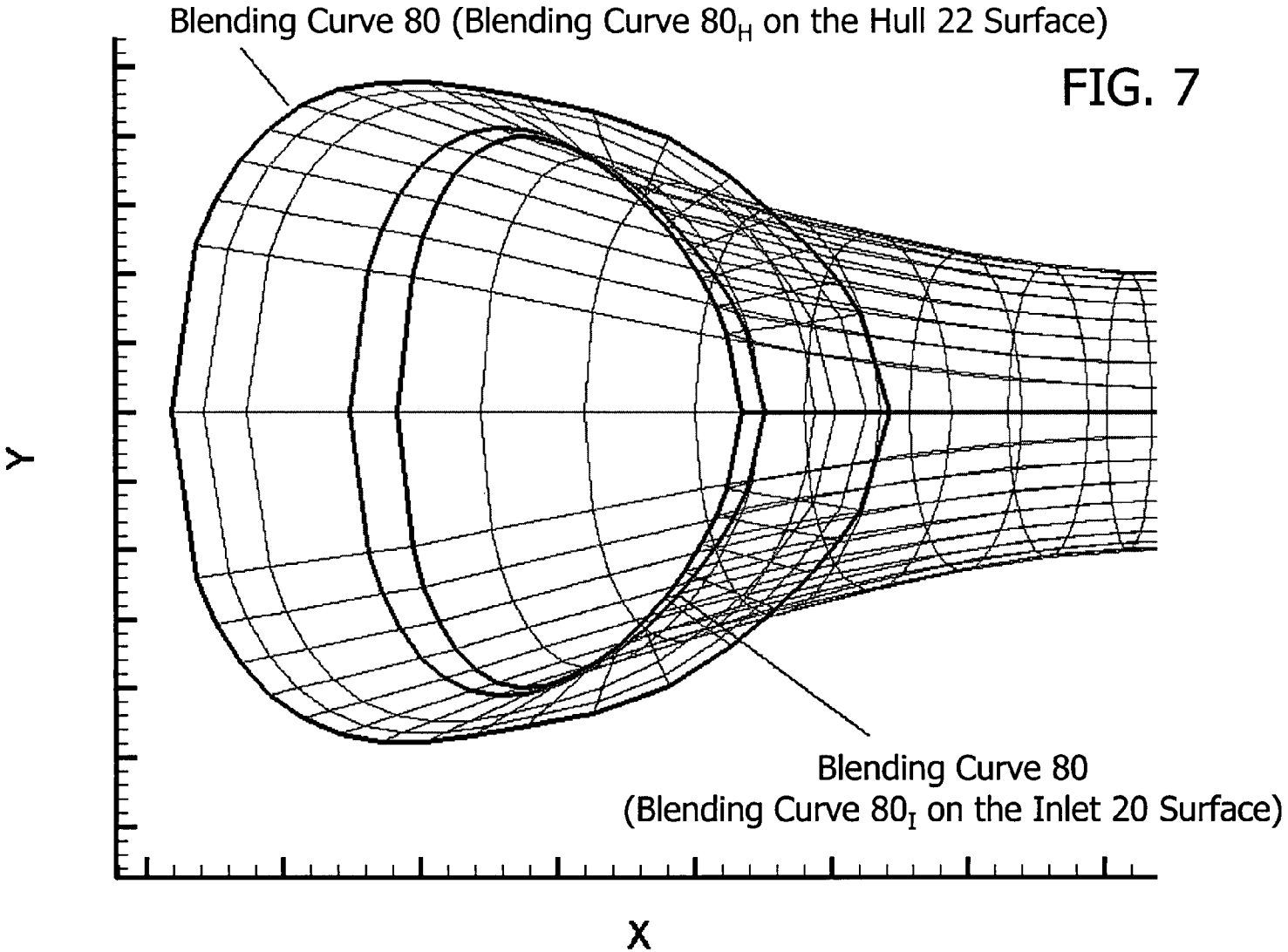
FIG. 7 is a plan view, from beneath the hull, of the inventive flush inlet shown in FIG. 1, illustrating the inventive use of blending curves as defined on the hull surface and inlet surface, to blend the inlet onto the hull surface.

Still referring to FIG. 3, and also referring to FIG. 7, plural cross-planes 40 that are normal to reference line a can be established along reference line a. Cross-planes $\mathbf{40}_{G\text{-}G'}$, $\mathbf{40}_{F\text{-}F'}$, $\mathbf{40}_{E\text{-}E'}$, $\mathbf{40}_{D\text{-}D'}$ and $\mathbf{40}_{C\text{-}C'}$ are shown in FIG. 3. The first cross-plane 40, viz., cross-plane $\mathbf{40}_{G\text{-}G'}$, defines the shape of inlet opening 26. The last cross-plane 40, viz., cross-plane $\mathbf{40}_{C\text{-}C'}$, defines the shape of outlet opening 28, which matches the forward face of the pump 38 casing. The inventive designer can select the areas and shapes of the cross-planes 40 as a function of position along the inlet reference line a. The decision on the area distribution along reference line a is mainly dictated by the flow diffusion or acceleration requirement through the inlet flow passage 30.

Figure 4:
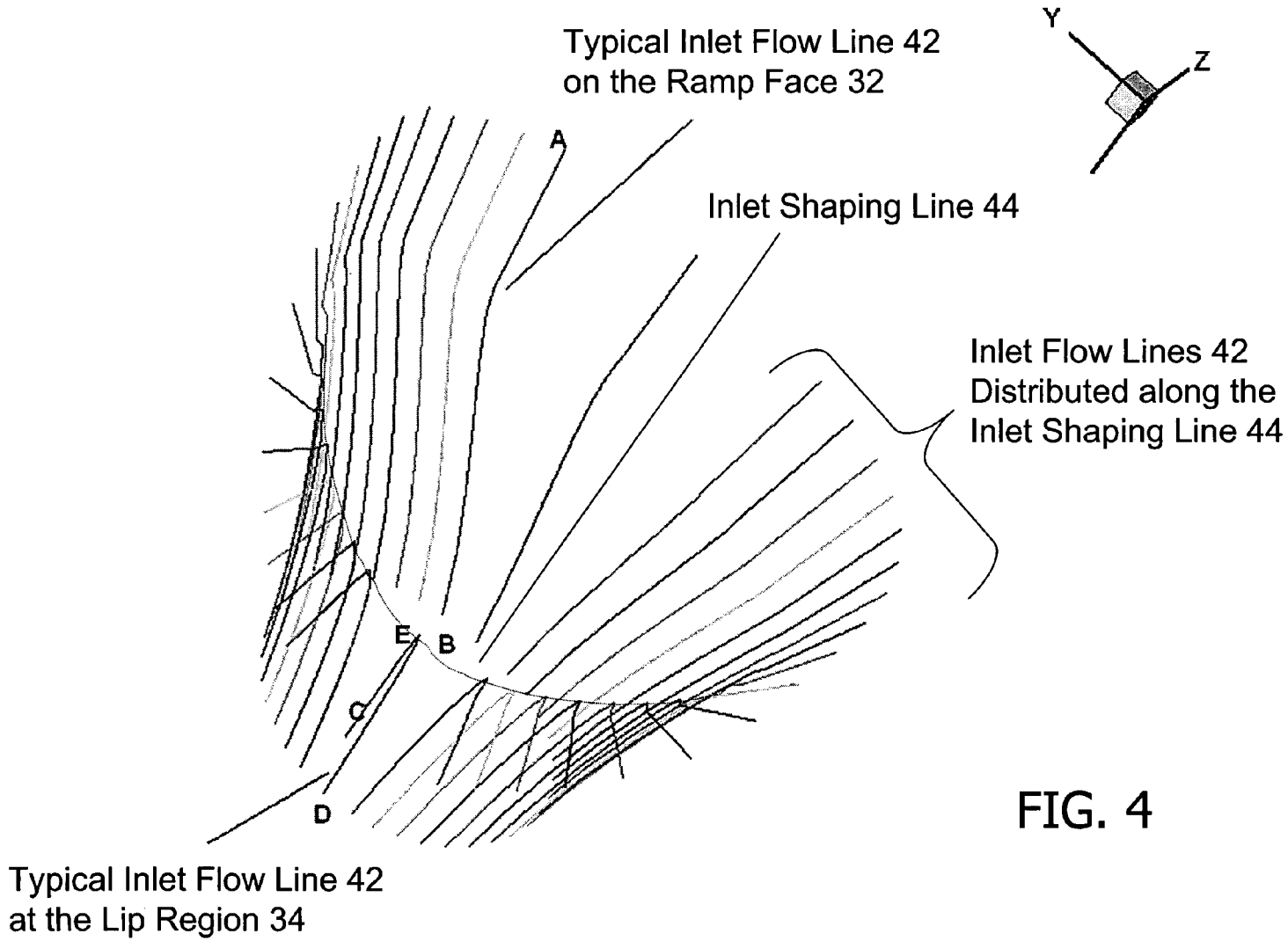
FIG. 4 is a perspective view of the inventive flush inlet shown in FIG. 1, illustrating the distribution of inlet flow lines around the circumference of the inlet shaping line.

Generally, each reference line a passes through the centroid c of the corresponding cross-plane 40. Cross-planes 40 are analytically defined closed curves. Each cross-plane 40 can be divided in angular segments by revolving around the centroid c of the closed curve. Five cross-planes 40 that describe the inlet shape can be established at this stage. The circumference of the closed cross-planes 40 can be equally divided into a number of segments (uniform distribution). The same number of divisions is applied to all cross-planes 40. The cross-planes 40 along the reference line a are connected via connecting each point on the circumference of the cross-planes 40 as the function of angular position. The number of the linking curves that connect the cross-planes 40 is equal to the number of angular divisions of cross-planes 40. The present invention typically uses a fifth-order Bezier cross-link curve to connect the cross-planes 40 at each angular position. The Bezier cross-link curves that connect the cross-planes 40 are defined as the inlet flow lines (IFL) 42, which are shown in FIG. 4 for a typical inlet 20 configuration. With reference to FIG. 4, line "A-B" represents a typical inlet flow line 42 on the ramp face 32. Line "D-E-C" represents a typical inlet flow line 42 at the lip region 34. Other inlet flow lines 42 are shown distributed along the inlet shaping line (ISL) 44.

Figure 5:
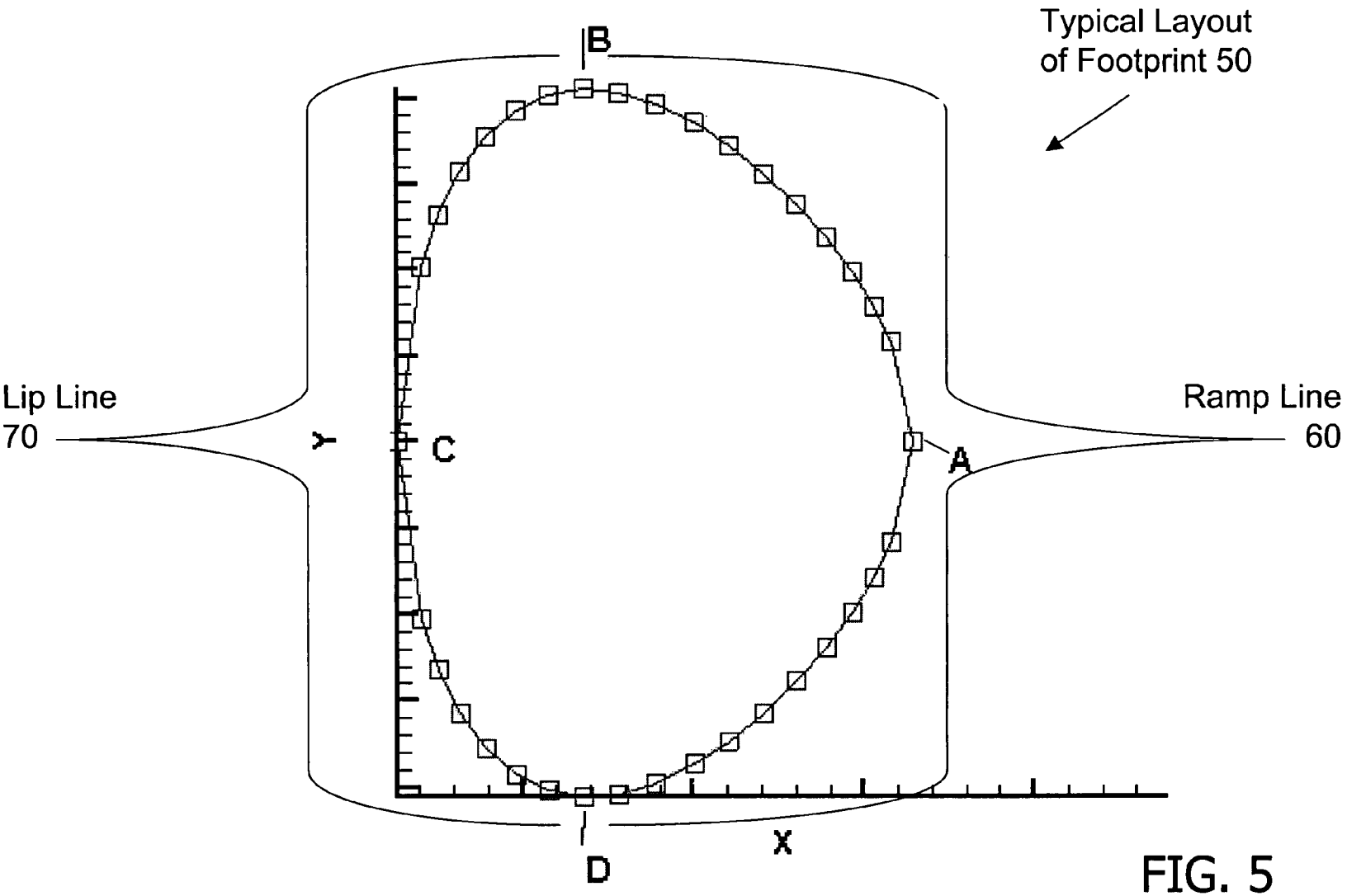
FIG. 5 is a plan view, from beneath the hull, of the footprint layout of the inventive flush inlet shown in FIG. 1, illustrating the composition of the footprint in terms of ramp and lip parts.

The hull 22 surface definition in the vicinity of the inlet 20 is usually required in the present invention's inlet 20 modeling. The planar outline of the inlet 20 shape is defined in a geometric plane such that the normal to the plane is the same as the normal to the hull 22 at the origin "A" of the reference line a. The inlet 20 outline on the planar surface is referred to herein as the "footprint" of the inlet shape. A typical outline of the footprint 50 of the inlet 20 shape is depicted in FIG. 5. In general, the footprint 50 can be defined along the hull 22 body coordinate system, with the major line along the hull 22 longitudinal direction and the minor line along the hull 22 transverse direction. The forward portion of the footprint 50 outlines the ramp 32 portion of the inlet 20 shape. Ramp line 60 is shown in FIG. 5 as curve "D-A-B" (i.e., the curved line segment having extreme points "D" and "B" and passing through point "A" therebetween). The rearward portion of the footprint 50 outlines the lip 34 portion of the inlet 20 shape. Lip line 70 is shown in FIG. 5 as curve "B-C-D" (i.e., the curved line segment having extreme points "D" and "B" and passing through point "C" therebetween).

Figure 6:
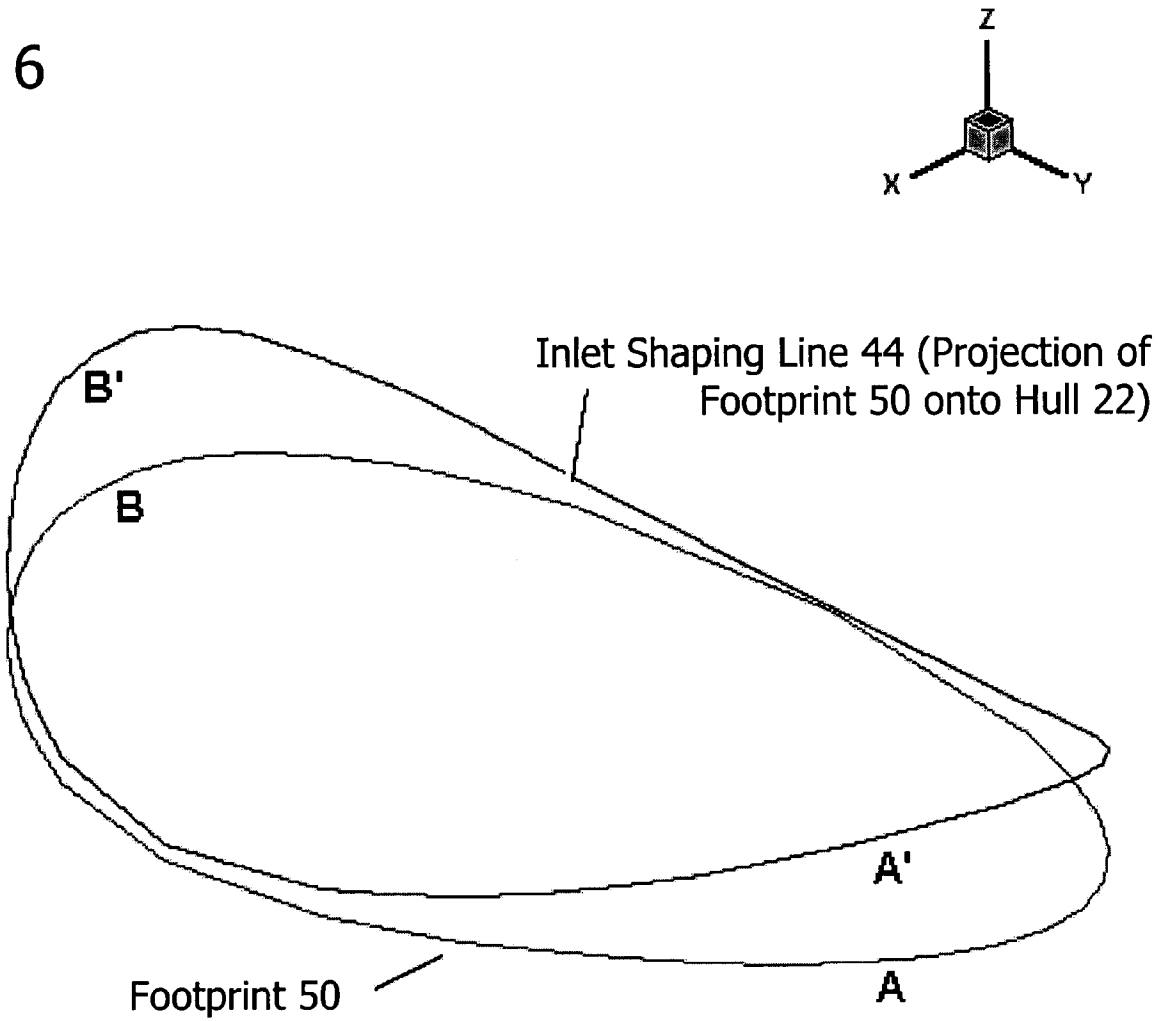
FIG. 6 is a perspective view of the footprint layout shown in FIG. 5, illustrating the projection of the footprint layout to the hull surface.

The footprint 50, shown in FIG. 6 as closed curve "A-B," is then projected onto the surface of the hull 22. Different projection schemes can be invoked during the inventive design process. Shown in FIG. 6 is a typical projected footprint 50 on a hull 22 surface of a body of revolution 220. The projected footprint 50, shown as closed curve "A'-B'," is referred to herein as the inlet shaping line (ISL) 44. A uniform projection scheme involves projection of the footprint 50 to the hull 22 at a specified angle relative to the planar surface. The projection angle depends on the topology of the body shape at the location of the inlet 20. A non-uniform (variable) projection scheme allows variable angles of projection of the inlet shaping line 44 to the hull 22 surface. The variable scheme provides additional control in inlet 20 shaping on the hull 22 surface.

ISL 44, the projection of footprint 50 (the planar inlet outline curve) on the hull 22, automatically creates discontinuity across the hull 22 surface and the inlet 20 surface. A fairing scheme is needed to ensure curvature continuity from the hull 22 to the inlet 20. The fairing scheme involves defining two reference curves as the blending curves 80, which will provide the location along the inlet flow lines 42 and the location on the hull 22 where the fairing between the hull 22 and the inlet 20 should occur. A demonstration of blending curves 80 is shown in FIG. 7 for a typical inlet-hull configuration. Blending curve $\mathbf{80}_H$ is on the hull 22 surface. Blending curve $\mathbf{80}_I$ is on the hull inlet 20 surface. Blending curves $\mathbf{80}_H$ and $\mathbf{80}_I$ serve to delimit the fairing. The fairing can be conducted along each IFL 42 and the points on the hull 22 by a cubic spline that will preserve slopes and curvatures continuity on the boundaries. Defining an axial and an angular bias can further control the general topology of the inlet-hull intersection. An axial bias is an axial displacement of the origin of inlet reference line a along the major line of the footprint 50. An angular bias is defined as a non-uniform distribution of points along the ISL 44.

Figure 8:
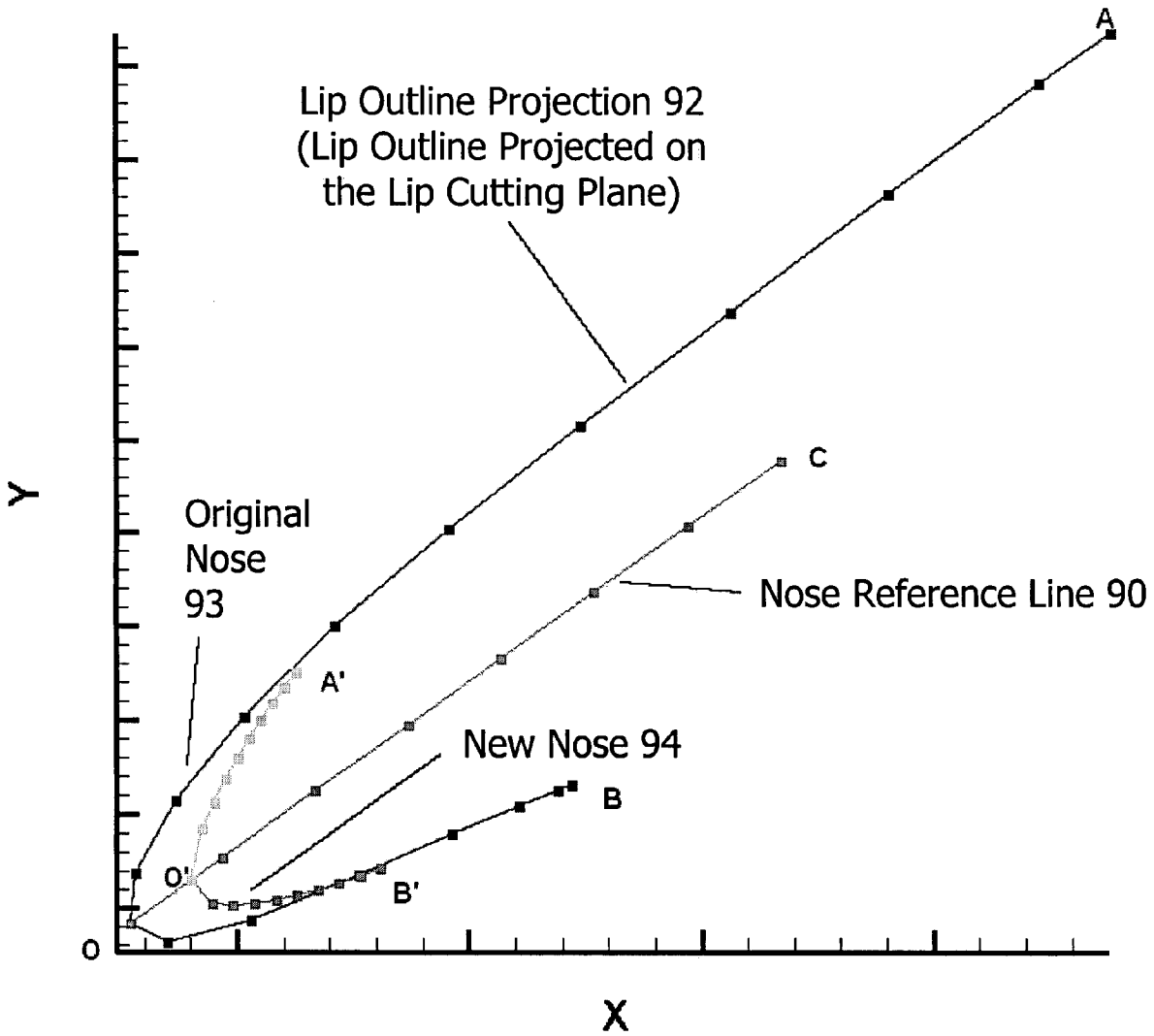
FIG. 8 is a cross-sectional view illustrating the geometrical layout of the lip nose geometry.

The lip 34 portion of the inlet 20 requires special attention, and a robust definition of the inlet lip 70 shape is usually critical to the success of the present invention's inlet 22 design. The lip 70 can be characterized by defining a cutting plane through the lip 34 region of the inlet 22. In general, a cutting plane is a planar surface that can be specified to be aligned with the stagnated streamline at the lip 70. The outline of the lip 70 shape on the cutting plane can be modified if there is a need to improve the inlet flow at the lip 70 region to prevent flow separation or improve cavitation performance. A nose reference line 90, such as shown in FIG. 8 as curve "O'-O-C," can be defined by identifying the leading edge radius and the leading edge location of the lip 70.

An analytically defined leading edge shape can be implemented along the portion of the inlet shaping line 44 where the lip 70 is located. Lip outline projection 92, the inlet lip line 70 geometry as projected onto the lip-cutting plane, is shown in FIG. 8 as curve "A-O-B." According to typical embodiments of the present invention, an elliptical nose 93 with an exponential weighted function from the leading edge is prescribed. The major axis of the weighted elliptical function is along the nose reference line 90. The original, elliptical nose 93 is blended into the hull line and lip nose cutting plane by matching the locations, slopes and/or curvatures. The new nose 94, the final lip nose geometry as transformed back to the IFL coordinates, is shown in FIG. 8 as curve "A'-O'-B'."

In accordance with the multifarious embodiments of the present invention, inventive modeling approaches other than those described hereinabove can be inventively implemented. For instance, depending on the inventive embodiment, varous spline algorithms can be used in modeling the inlet flow lines and/or the inlet shaping lines.

Figure 9:
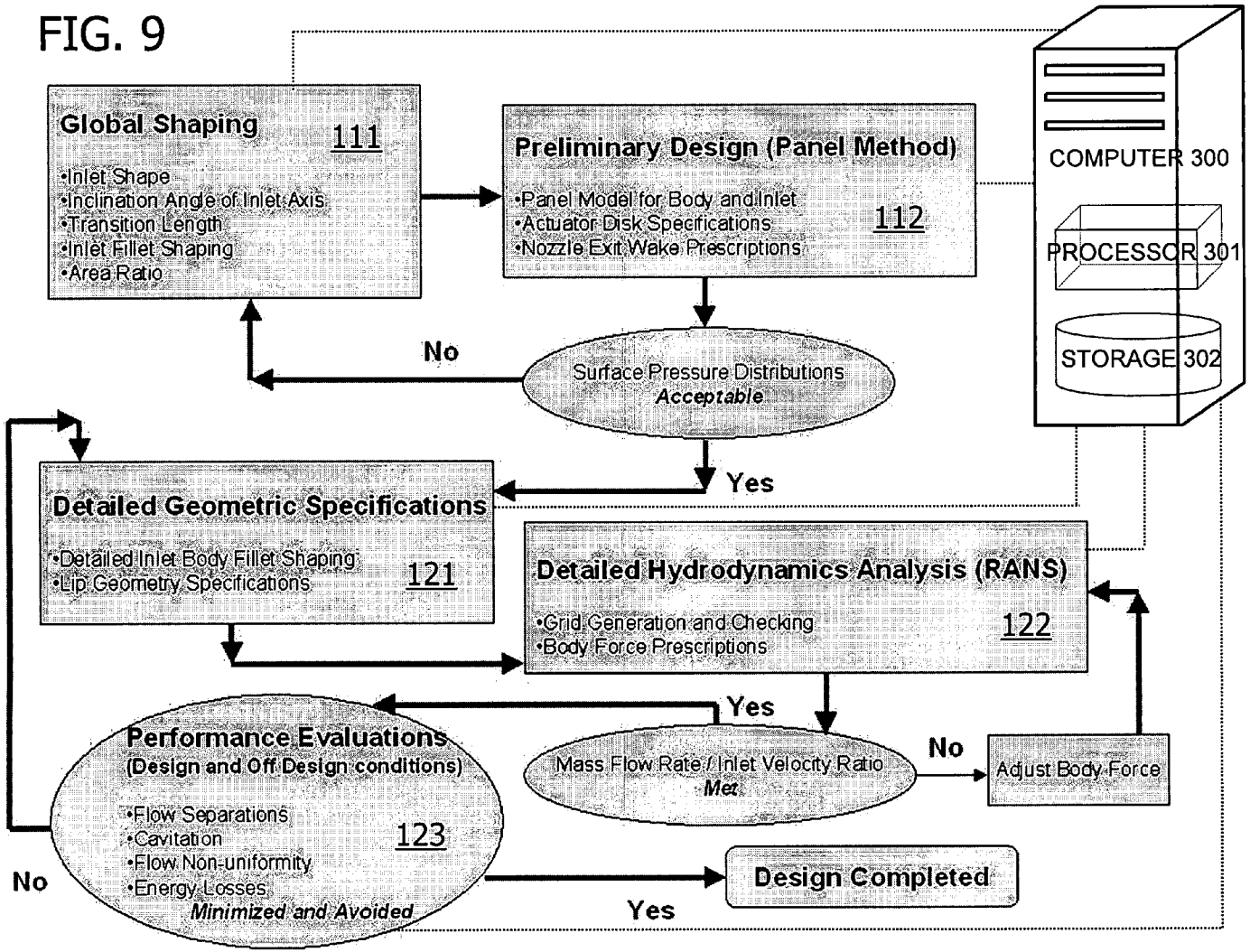
FIG. 9 is a flow diagram of a typical design method in accordance with the present invention.

Reference now being made to FIG. 9, according to typical inventive embodiments a two-level or two-phase approach is taken that includes (i) a preliminary design and analysis procedure and (ii) a detailed performance analysis using computational fluid dynamics (CFD). A schematic of a typical inventive two-phase design process is depicted in FIG. 9. The preliminary design and analysis phase includes global shaping 111 and preliminary design (panel method) 112. The performance analysis phase includes detailed geometric specifications 121, detailed hydrodynamics analysis 122, and performance evaluations (design and off-design conditions) 123. Each of these phase components lends itself to processing using a computer 300 that includes a processor 301 and a storage device 302, along with peripherals such as interface equipment (e.g., keyboard and mouse), a display unit and a printer. The software tools for the preliminary design and analysis phase include an enhanced inlet geometry code and a potential flow code.

VSAERO is CFD software manufactured by Analytical Methods, Inc. (AMI). AMI's main office location is 2133 152nd Avenue NE, Redmond, Wash., 98052; AMI's east coast office location is 4100 North Fairfax Drive, Suite 800, Arlington, Va., 22203; AMI has a website. VSAERO is described by Maskew B., "Program VSAERO: A Computer Program for Calculating the Non-Linear Aerodynamic Characteristics of Arbitrary Configurations," AMI report, Contract No. NAS2-11945, NASA Ames Research Center (December 1984), incorporated herein by reference.

$U^2$NCLE (Unstructured Unsteady Computation of Field Equations) is CFD software developed by the Engineering Research Center Computational Simulation and Design Center (ERC SimCenter) of the College of Engineering of Mississippi State University. The ERC SimCenter street address is 2 Research Boulevard, Starkville, Miss., 39759; the ERC SimCenter has a website. The following paper, incorporated herein by reference, is informative about $U^2$NCLE: Eric. L. Blades, David L. Marcum, Brent Mitchell, "Simulation of Spinning Missile Flow Fields Using $U^2$NCLE," $20^{th}$ AIAA Applied Aerodynamics Conference, St. Louis, Mo., 24-26 Jun. 2002.

The present invention's preliminary design and analysis provide inlet parametric study based upon the geometric characterizations for flush inlets. The Panel code VSAERO is used to provide comparative design predictions based on potential flow theory in selecting appropriate geometric variations in the parametric study. Sensitivities can be conducted to assess the relative importance of various geometric parameters to inlet flow. Candidates are selected based on the preliminary evaluations for the detailed analysis. The main tool for the detailed analysis is the unstructured $U^2$NCLE (3D RANS) code. The detailed analysis provides velocity and pressure distributions on the inlet surface and the inlet flow passage. Design parameters of interest—e.g., mass-flow rates, inlet losses, and flow distortions at the impeller face—can be characterized based on the computed velocities and pressure.

Figure 10:
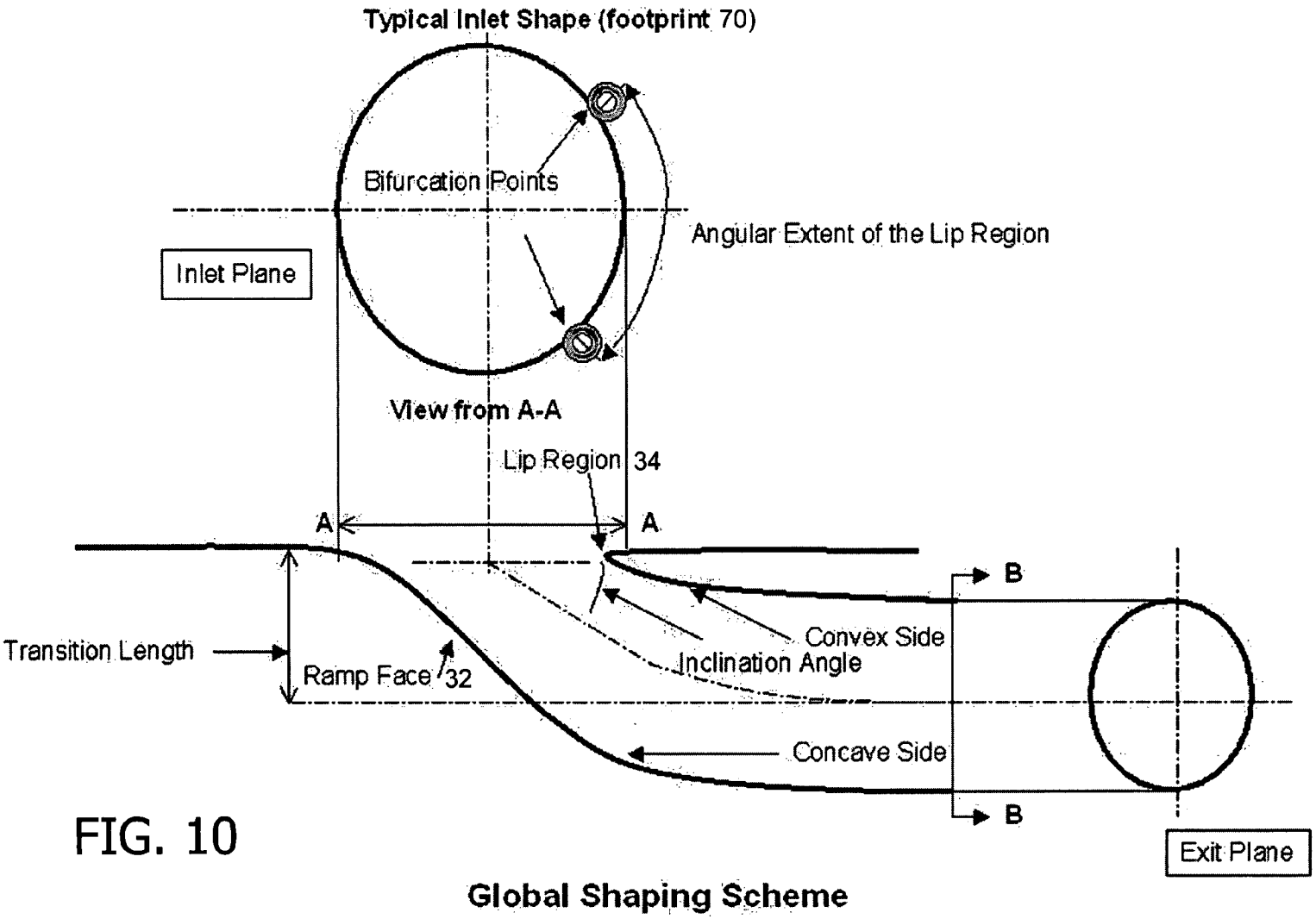
FIG. 10 is an inverted elevation view of the inventive flush inlet shown in FIG. 1, illustrating various parameters considered according to the present invention.

Preliminary design of an inlet includes a global shaping 111 scheme and design by analysis 112 that uses potential flow-based panel code VSAERO. With reference to FIG. 10, the global shaping 111 scheme requires five major design specifications, as follows: (i) the inlet shape, which can be any shape of interest; (ii) the transition length; (iii) the inclination angle along the inlet line, which is the angle formed between the inlet plane with the attendant reference coordinate system; (iv) the inlet fillet control/fairing by using both axial and angular bias as defined hereinabove; and, (v) area ratio scheduling between the inlet plane and the exit plane. In the global shaping 111, the parametric study is conducted by varying these five major parameters. In general, variations in the inclination angle and the transition length are limited by the physical space available inside the hull where the inlet is located. The inlet shapes need to be determined by considering the geometry of the external hull shape, subject to the constraints of inclination angle and transition length. Local fillet controls can be exercised to fine-tune the blending of inlet to the hull.

In practicing the present invention, there is no exact design theory available at this time to explicitly define inlet shapes based on the given constraints and the specified design objectives. Parametric studies need to be conducted at the preliminary design stage to establish pertinent features that further good inlet design. It is recognized at this time that the design parametric space for inlet design is enormous, and that it is necessary to reduce the size of the design space significantly so that the computational task is manageable. In the absence of development in this regard, inventive design typically is restricted to the class of oval shapes. An elliptical shape can be considered as a special case of oval shapes with skew factor of one (1). The determination of oval shape as the primary inlet shape of interest is a subjective judgment based on its topological property when it is blended on a surface of revolution.

In inventive testing, the panel code VSAERO was used to analyze the inlet-hull configuration. The results of potential flow simulations can only be interpreted on a comparative basis. Typically, in inventive practice, the flow variable of interest is the static pressure and its gradient information around and inside the inlet region. The primary objective for the preliminary design is thus to identify geometric features that produce the least amount of pressure gradient variations. Design candidates can be selected for detailed evaluations of their performance using RANS solver $U^2$NCLE. The RANS simulations provide detailed flow information that can be used to fine-tune the inlet geometry for better performance. Major parameters of interest are the thrust, mass flow rate, and jet velocity ratio (at the self-propulsion point).

The effectiveness of an inlet design in accordance with the present invention can be evaluated using criteria of desirable characteristics including the following: (i) no flow separation at inlet; (ii) minimizing inlet loss; (iii) shock-free entry; and, (iv) minimizing the inflow distortion at the pump face. Application of these (and other) criteria may militate in favor of effecting a re-design, at least to a limited degree, in accordance with the present invention. For instance, the fairing at the inlet hull junction including the lip geometry may need to be modified to improve the performance. Major re-design may be required if there is excess separation and highly distorted flow at the pump face.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications and changes to the principles disclosed herein may be made by one skilled in the art without departing from the true scope and spirit of the present invention, which is indicated by the following claims.

What is claimed is:

1. A method for designing the geometry of vehicular structure for fluid in-taking for fluid propulsion, the method comprising:

visually defining a global structural configuration including a fluid inlet and a hull portion, said visual defining of a global structural configuration being performed computationally using a computer and a display, said visual defining of a global structural configuration including visually defining an inlet reference line and visually defining at least three cross-planes, each said cross-plane intersecting said inlet reference line and being normal to said inlet reference line, said fluid inlet having a fluid entrance end and a fluid exit end, a first said cross-plane being located at said fluid entrance end, a second said cross-plane being located at said fluid exit end, said fluid inlet being integrated flush with said hull portion at said fluid entrance end, each said cross-plane having a centroid, said inlet reference line extending between said centroid of the first said cross-plane and said centroid of the second said cross-plane, said inlet reference line intersecting said centroid of each said cross-plane other than the first said cross-plane and the second said cross-plane;

visually defining a surface of said fluid inlet, said visual defining of a surface being performed computationally using a computer and a display, said visual defining of a surface including visually defining a footprint, visually defining an inlet shaping line, and visually defining at least three inlet flow lines, said footprint lying in a geometric plane and representing a closed planar outline of said fluid inlet at said fluid entrance end of said fluid inlet, said visual defining of said inlet shaping line including projecting said footprint onto said hull portion so that at least two angles of said projecting of said footprint are taken relative to said geometric plane in which said footprint lies, said inlet shaping line thereby representing a variably angled projection of said footprint onto said hull portion, each said inlet flow line connecting said cross-planes, said inlet flow lines being spaced at different angular positions around the circumference of said inlet shaping line, said defining of said inlet flow lines including using, with respect to each said inlet flow line, a fifth-order Bezier cross-link curve to connect said cross-planes at the corresponding said angular position;

visually defining a fairing between said hull portion and said fluid inlet at said fluid entrance end, said visual defining of a fairing being performed computationally using a computer and a display, said visual defining of a fairing including visually defining two closed fairing reference curves, a first said closed fairing reference curve being on said fluid inlet at said fluid entrance end and along said inlet flow lines, a second said closed fairing reference curve being on said hull portion, said fairing extending between said two closed fairing reference curves, said fairing being characterized by a topography that at least substantially maintains the directional properties of said inlet flow lines; and visually defining a lip nose, said visual defining of a lip nose being performed computationally using a computer and a display, said visual defining of a lip nose including visually defining a nose reference line for said footprint, visually defining a lip outline projection, visually defining an elliptical nose, and visually blending said elliptical nose into said hull portion and a lip nose cutting plane, said footprint including a lip section and a ramp section, said lip section being on the leading edge side of said footprint relative to said hull, said ramp section being on the trailing edge side of said footprint relative to said hull, said lip outline projection representing a projection of said lip section onto said lip nose cutting plane, said elliptical nose being characterized by a partially elliptical shape that is blended into said lip outline projection and that has its major axis coincident with said nose reference line, said visual blending of said elliptical nose including matching with respect to at least one of locations, slopes, and curvatures, said locations being the location of said elliptical nose, the location of said hull portion, and the location of said lip nose cutting plane, said slopes being the slope of said elliptical nose, the slope of said hull portion, and the slope of said lip nose cutting plane, said curvatures being the curvature of said elliptical nose, the curvature of said hull portion, and the curvature of said lip nose cutting plane.

2. The method of claim 1, wherein the method further comprises making said vehicular structure so as to include said fluid inlet, said hull portion, and said fairing.

3. A method for designing the geometry of vehicular structure for fluid in-taking for fluid propulsion, the method comprising:

visually defining a global structural configuration including a fluid inlet and a hull portion, said visual defining of a global structural configuration being performed computationally using a computer and a display, said visual defining of a global structural configuration including visually defining an inlet reference line and visually defining at least three cross-planes, each said cross-plane intersecting said inlet reference line and being normal to said inlet reference line, said fluid inlet having a fluid entrance end and a fluid exit end, a first said cross-plane being located at said fluid entrance end, a second said cross-plane being located at said fluid exit end, said fluid inlet being integrated flush with said hull portion at said fluid entrance end, each said cross-plane having a centroid, said inlet reference line extending between said centroid of the first said cross-plane and said centroid of the second said cross-plane, said inlet reference line intersecting said centroid of each said cross-plane other than the first said cross-plane and the second said cross-plane; and visually defining a surface of said fluid inlet, said visual defining of a surface being performed computationally using a computer and a display, said visual defining of a surface including visually defining a footprint, visually defining an inlet shaping line, and visually defining at least three inlet flow lines, said footprint lying in a geometric plane and representing a closed planar outline of said fluid inlet at said fluid entrance end of said fluid inlet, said visual defining of said inlet shaping line including projecting said footprint onto said hull portion so that at least two angles of said projecting of said footprint are taken relative to said geometric plane in which said footprint lies, said inlet shaping line thereby representing a variably angled projection of said footprint onto said hull portion, each said inlet flow line connecting said cross-planes, said inlet flow lines being spaced at different angular positions around the circumference of said inlet shaping line, said defining of said inlet flow lines including using, with respect to each said inlet flow line, a fifth-order Bezier cross-link curve to connect said cross-planes at the corresponding said angular position.

4. The method of claim 3, wherein the method further comprises visually defining a fairing between said hull portion and said fluid inlet at said fluid entrance end, said visual defining of a fairing being performed computationally using a computer and a display, said visual defining of a fairing including visually defining two closed fairing reference curves, a first said closed fairing reference curve being on said fluid inlet at said fluid entrance end and along said inlet flow lines, a second said closed fairing reference curve being on said hull portion, said fairing extending between said two closed fairing reference curves, said fairing being characterized by a topography that at least substantially maintains the directional properties of said inlet flow lines.

5. The method of claim 3, wherein the method further comprises visually defining a lip nose, said visual defining of a lip nose being performed computationally using a computer and a display, said visual defining of a lip nose including visually defining a nose reference line for said footprint, visually defining a lip outline projection, visually defining an elliptical nose, and visually blending said elliptical nose into said hull portion and a lip nose cutting plane, said footprint including a lip section and a ramp section, said lip section being on the leading edge side of said footprint relative to said hull, said ramp section being on the trailing edge side of said footprint relative to said hull, said lip outline projection representing a projection of said lip section onto said lip nose cutting plane, said elliptical nose being characterized by a partially elliptical shape that is blended into said lip outline projection and that has its major axis coincident with said nose reference line, said visual blending of said elliptical nose including matching with respect to at least one of locations, slopes, and curvatures, said locations being the location of said elliptical nose, the location of said hull portion, and the location of said lip nose cutting plane, said slopes being the slope of said elliptical nose, the slope of said hull portion, and the slope of said lip nose cutting plane, said curvatures being the curvature of said elliptical nose, the curvature of said hull portion, and the curvature of said lip nose cutting plane.

* * * * *